US006769875B2

(12) United States Patent
Tiemann

(10) Patent No.: US 6,769,875 B2
(45) Date of Patent: Aug. 3, 2004

(54) COOLING SYSTEM FOR A TURBINE BLADE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 12 days.

(21) Appl. No.: 10/239,234

(22) PCT Filed: Mar. 12, 2001

(86) PCT No.: PCT/EP01/02755

§ 371 (c)(1),
(2), (4) Date: Sep. 20, 2002

(87) PCT Pub. No.: WO01/71163

PCT Pub. Date: Sep. 27, 2001

(65) Prior Publication Data

US 2003/0049127 A1 Mar. 13, 2003

(30) Foreign Application Priority Data

Mar. 22, 2000 (EP) ..... 00106245

(51) Int. Cl.[7] ..... F01D 5/18
(52) U.S. Cl. ..... 416/97 R; 416/96 A; 416/233
(58) Field of Search ..... 416/90 R, 95, 416/96 A, 96 R, 97 R, 233, 232; 415/115

(56) References Cited

U.S. PATENT DOCUMENTS 429,677 A 6/1890 Catton
3,574,481 A * 4/1971 Pyne et al. ..... 416/90 R
3,628,880 A 12/1971 Smuland
4,118,146 A 10/1978 Dierberger
4,296,779 A 10/1981 Smick
5,419,039 A 5/1995 Auxier
5,468,125 A 11/1995 Okpara
5,695,321 A 12/1997 Kercher

FOREIGN PATENT DOCUMENTS

| | | |
|---|---|---|
| EP | 0541207 | 7/1992 |
| EP | 0905353 | 9/1997 |
| WO | 98/25009 | 12/1996 |

* cited by examiner

*Primary Examiner*—Edward K. Look
*Assistant Examiner*—Dwayne J. White
(74) *Attorney, Agent, or Firm*—Harness, Dickey & Pierce, P.L.C.

(57) ABSTRACT

The invention relates to a blade (13; 14) for a turbine (10), comprising at least one channel (22) which is delimited by walls (19, 20, 21). An insert (25) which can be subjected to the action of a liquid coolant is inserted into at least one channel (22). According to the invention, at least one of the walls (19; 20) is provided with a number of horizontal ribs (24) which are located between the insert (25) and the wall (19; 20). Said insert (25) is provided with openings (27) through which the liquid coolant passes out of the insert (25) and between the horizontal ribs (24). The liquid coolant is therefore conducted along the wall (19, 20) and guided by the horizontal ribs (24) in order to provide improved convection cooling.

19 Claims, 3 Drawing Sheets

COOLING SYSTEM FOR A TURBINE BLADE

This application is the national phase under 35 U.S.C. §371 of PCT International Application No. PCT/EP01/02755 which has an International filing date of Mar. 12, 2001, which designated the United States of America and which claims priority on European Patent Application number EP 00106245.4 filed Mar. 22, 2000, the entire contents of which are hereby incorporated herein by reference.

FIELD OF THE INVENTION

The invention generally relates to a blade/vane. In particular, it relates to a turbine blade/vane, having at least one duct which is bounded by walls, a cooling fluid being admitted to an insert which is introduced into at least one duct.

BACKGROUND OF THE INVENTION

A blade/vane is known from U.S. Pat. No. 5,419,039. Chambers, which extend in the direction of a longitudinal center line of the blade/vane, are formed between the insert and the walls of the blade/vane. The cooling fluid emerges from the insert into these chambers and impinges on the walls of the blade/vane. The cooling fluid subsequently flows along the walls and emerges through outlet openings into specially shaped chambers on the outside of the walls and from there into the surroundings. In the known blade/vane, the effect of the convection cooling, when the cooling fluid is flowing along the walls, is only slight because the flow length is greatly limited. In addition, mixing of the cooling fluid in the chambers occurs along the longitudinal center line of the blade/vane, so that no targeted cooling is possible.

Another blade/vane is known from WO 98/25009, which originates from the same assignee. This publication describes a blade/vane with walls which have a locally hollow configuration and through which a cooling fluid flows. A high level of cooling efficiency is achieved because of the reduction of the wall thickness in the region of the hollow chambers. Blades/vanes with such hollow walls, however, require a complicated casting procedure with high scrap rates and they are therefore very expensive.

SUMMARY OF THE INVENTION

An object of an embodiment of the present invention is, therefore, to make available a blade/vane which, using a simple manufacturing process, achieves an improvement in the cooling effect. According to an embodiment of the invention, an object may be achieved, in the case of a blade/vane, by at least one of the walls being provided with a number of horizontal ribs. These ribs may be arranged between the insert and the wall. Further, the insert may be provided with openings, through which the cooling fluid from the insert can enter between the horizontal ribs.

The horizontal ribs conduct the coolant along the wall of the blade/vane and prevent a flow of the coolant in the direction of the longitudinal center line of the blade/vane. Good convection cooling of the wall is, therefore, achieved. In addition, the horizontal ribs reinforce the blade/vane so that the wall thickness can be reduced. A reduction in the wall thickness leads to an increased cooling efficiency. The manufacture of the blade/vane can take place without complex cross section, using known methods. Hollow walls are not necessary. The scrap quota is therefore substantially reduced.

In an advantageous embodiment, the insert touches the horizontal ribs. The insert is supported and aligned in the desired position.

According to an advantageous development of one embodiment, the horizontal ribs, the insert and the wall may form chambers through which the cooling fluid flows. A flow of the cooling fluid in the direction of the longitudinal center line of the blade/vane may be reliably prevented by the chambers. In addition, the cooling effect can be varied, in a targeted manner, along the longitudinal center line of the blade/vane by differentially admitting cooling fluid to the chambers.

In an advantageous embodiment, the openings of the insert are arranged at a first end of the chambers and outlet openings for the cooling fluid are arranged in the wall at a second end of the chambers. The cooling fluid therefore flows along the wall to be cooled over the complete length of the chamber, so that the convection cooling is further improved.

The horizontal ribs can be arranged substantially at right angles to the longitudinal center line of the blade/vane. As an alternative, an angular position can be provided. In the case of an arrangement at right angles with respect to the longitudinal center line, the length of the horizontal ribs, and therefore of the chambers, is minimized. The angular position permits an increase in the length of the chambers and, therefore, further improved convection cooling.

The insert is advantageously closed at one end. In this case, the cooling fluid is only supplied from the other end of the insert. Emergence of the cooling fluid through the end facing away from the supply end is prevented, so that the cooling efficiency is increased. As an alternative, the cooling fluid can be supplied from both ends.

According to an advantageous embodiment, turbulators are used to reinforce the wall and merge into one another and into the horizontal ribs. By this, a substantial increase in the stiffness is achieved without additional material. For the same strength of the blade/vane, the wall thickness can be further reduced. Good heat exchange between the walls and the cooling fluid is achieved at the same time. The result is, therefore, a high cooling efficiency and a high overall efficiency.

The reinforcement of the wall does not only occur in the region of an individual turbulator. A large-area reinforcement is, in fact, provided by the connection of the turbulators to one another. The turbulators have, advantageously, a straight configuration. The use of straight turbulators permits a high level of reinforcement, in conjunction with simple manufacture.

According to an advantageous embodiment, the turbulators are arranged in such a way that, together with the horizontal ribs, they form recesses adjacent to one another in the form of polygons, in particular triangles or rhombuses. The inside of the wall is provided with a honeycomb structure. The individual polygons or honeycombs respectively form a closed cross section with high load-bearing capability and mutually support one another. A substantial increase in the stiffness can be achieved.

In an advantageous development, the wall thickness of the wall is reduced, at least in the region between the turbulators. This reduction in the wall thickness is made possible because the turbulators effect a reinforcement of the wall. Due to the reduction in the wall thickness, the cooling efficiency is further increased. In this arrangement, the turbulators can be advantageously used as metal feed ducts during the casting of the blade/vane. The honeycomb structure can therefore be conveniently manufactured.

The blade/vane according to an embodiment of the invention can be configured as guide vanes or as rotor blades of a turbomachine.

BRIEF DESCRIPTION OF THE DRAWINGS

The invention is described in more detail below using embodiment examples, which are diagrammatically represented in the drawing. The same designations are used for similar or functionally identical components throughout. In the drawings.

DETAILED DESCRIPTION OF THE PREFERRED EMBODIMENTS

Figure 1:
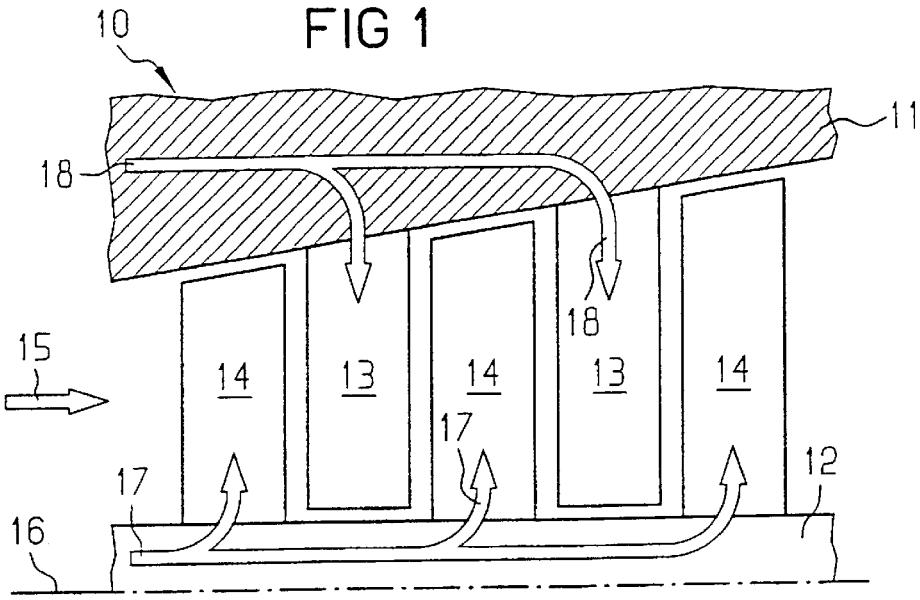
FIG. 1 shows a longitudinal section through a turbomachine.

FIG. 1 shows a longitudinal section through a turbomachine in the form of a turbine 10 with a casing 11 and a rotor 12. The casing 11 is provided with guide vanes 13 and the rotor 12 is provided with rotor blades 14. In operation, fluid flows through the turbine 10 in the arrow direction 15, this fluid flowing along the guide vanes 13 and rotor blades 14 and setting the rotor 12 into rotation about a center line 16.

In many applications, the temperature of the fluid is relatively high, particularly in the region of the first blading row (shown on the left in FIG. 1). For this reason, a cooling system is provided for the guide vanes 13 and rotor blades 14. The flow of the cooling fluid is diagrammatically indicated by the arrows 17, 18.

Figure 2:
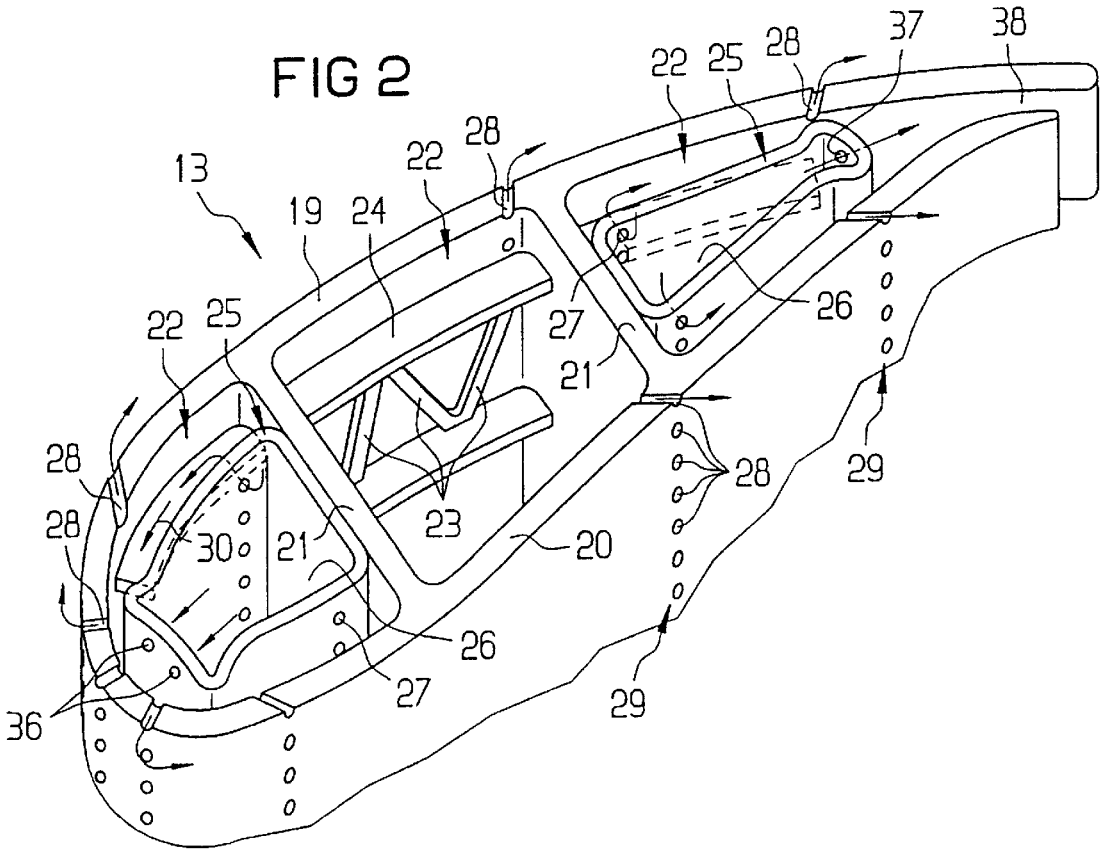
FIG. 2 shows a perspective, exploded representation of a blade/vane.

FIG. 2 shows, diagrammatically, an exploded representation of a guide vane 13. The guide vane 13 has curved outer walls, 19, 20. The internal space located between the outer walls 19, 20 is subdivided into a total of three ducts 22 by means of two separating walls 21. An insert 25 is inserted into each of the ducts 22. For better representation, the insert of the central duct 22 is not shown.

The two outer walls 19, 20 are provided with a number of horizontal ribs 24 in each of the ducts 22. The horizontal ribs 24 extend along the walls 19, 20 and extend as far as the separating walls 21. Turbulators 23 are arranged between the horizontal ribs 24. The inserts 25 touch the horizontal ribs 24.

The cooling fluid, in particular cooling air, is supplied to an internal space 26 of the inserts 25. The inserts 25 are provided with a number of openings 27 through which the cooling fluid emerges into the intermediate space between the outer walls 19, 20 and the insert 25. The cooling fluid subsequently flows along the outer walls 19, 20 as far as outlet openings 28 in the walls 19, 20. This flow is diagrammatically indicated by the arrow 30. In this arrangement, the openings 27 of the inserts 25 are arranged at a distance from the outlet openings 28 of the outer walls 19, 20. In the exemplary embodiment represented, the outlet openings 28 form substantially straight rows 29.

The cooling fluid emerging from the inserts 25 first impinges on the outer walls 19, 20, causing impingement cooling there. It subsequently flows along the outer walls 19, 20 as far as the outlet openings 28, so that a convection cooling is achieved. After emerging from the outlet openings 28, a film of the cooling fluid forms on the outside of the outer walls 19, 20, so that film cooling is likewise made available. This provides a substantially improved cooling.

The leading edge of the guide vane 13 represented to the left in FIG. 2 is additionally provided with direct impingement cooling. For this impingement cooling, the insert 25 has further openings 36, which are arranged directly behind the leading edge of the guide vane 13. The cooling medium emerges directly via these openings 36 and provides specific cooling of the leading edge of the guide vane 13.

Figure 3:
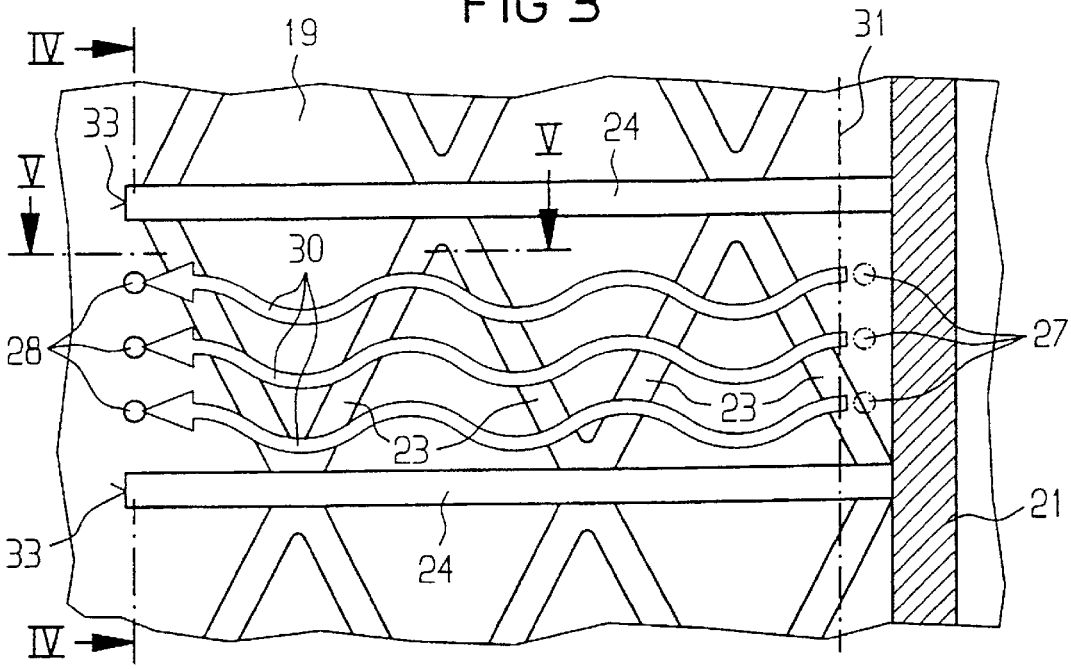
FIG. 3 shows an end view onto the inside of a wall of the blade/vane.
Figure 4:
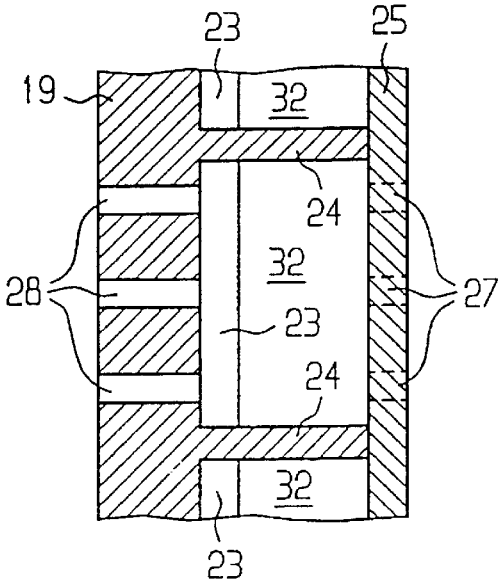
FIG. 4 shows a section along the line IV—IV in FIG. 3.
Figure 5:
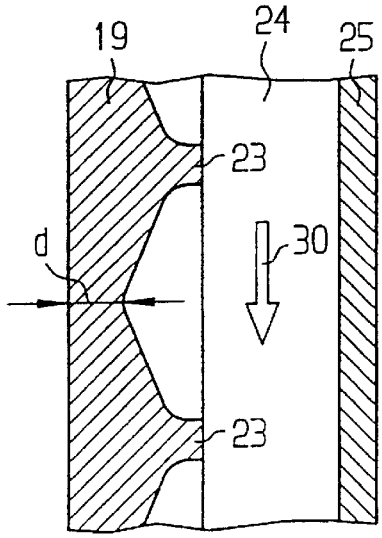
FIG. 5 shows a section along the line V—V in FIG. 3.

The associated insert 25 is also provided with a further opening 37 in the region of the trailing edge of the guide vane 13. Through this opening 37, cooling fluid emerges directly into a narrow gap 38 between the outer walls 19, 20 and effects film cooling there. FIGS. 3 to 5 show more precise details of the inside of the outer wall 19. The horizontal ribs 24 extend substantially at right angles to the longitudinal center line 31 of the guide vane 13. They are arranged parallel to one another. Straight turbulators 23 are arranged between the horizontal ribs 24 and these turbulators 23 merge into one another and into the horizontal ribs 24.

The leading edge 33 of the horizontal ribs 24 merges into the separating wall 21 in the case of the central duct 22. In the case of the left-hand duct 22 in FIG. 2, the leading edge 33 is arranged at a distance relative to the outlet openings 28 which are furthest forward.

Each two horizontal ribs 24, together with the outer wall 19 and the insert 25, bound a chamber 32. The cooling fluid emerges through the openings 27 of the insert 25 into this chamber 32. It subsequently flows, as shown by the arrow direction 30, to the outlet openings 28. In this arrangement, the openings 27 are arranged at one end of the chamber 32 and the outlet openings 28 are arranged at the other end. This maximizes the distance which the cooling fluid passes over when flowing along the outer wall 19. There is, therefore, a maximum convection cooling. The effect of the convection cooling is further strengthened by the turbulators 23 because the latter improve the heat exchange between the outer wall 19 and the cooling fluid.

The cooling fluid can be differentially admitted to the chambers 32. This is achieved by a variation of the number and/or size of the openings 27 of the insert 25. In this way, individual chambers 32 can, in a targeted manner, be more strongly or less strongly cooled than others. The cooling can therefore be adjusted in a targeted manner along the longitudinal center line 31 of the guide vane 13 and matched to the boundary conditions present.

The turbulators 23 are additionally used for reinforcing the outer wall 19. In this arrangement, the straight turbulators 23 are arranged in such a way that they form polygons. In FIG. 3, triangles are presented as an example and in FIG. 6, rhombuses are presented as examples. The reinforcement achieved by means of the turbulators 23 permits a reduction in the wall thickness d of the outer wall 19 in the region between the turbulators 23. Because of this reduction in the wall thickness d, the cooling efficiency is further increased.

Figure 6:
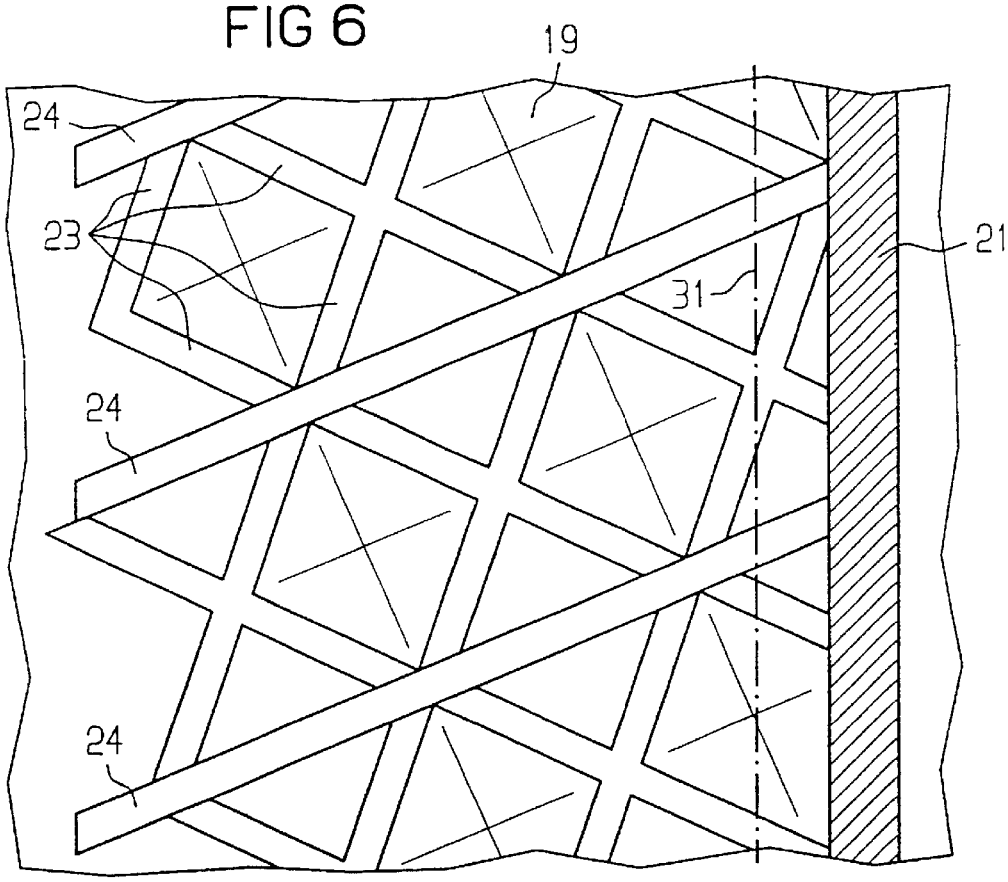
FIG. 6 shows a view similar to FIG. 3 in a second embodiment.

FIG. 6 shows an end view onto the inside of the outer wall 19 in a second embodiment. In this embodiment, the turbulators 24 are inclined relative to the longitudinal center line 31 of the guide vane 13. Because of this inclination, the length of the chambers 32 is increased and, therefore, the efficiency of the convection cooling is increased. In this embodiment also, straight turbulators 23 are provided and four of these are combined to form a rhombus in each case. The reduction in the wall thickness is diagrammatically indicated in these rhombuses by means of visible edges.

The second outer wall 20 is also, of course, provided with corresponding turbulators 23 and horizontal ribs 24. The horizontal ribs 24 and the turbulators 23 can also be provided, alternatively or additionally, in the case of a rotor blade 14.

Figure 7:
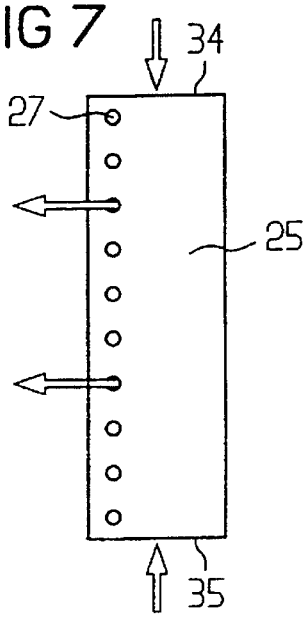
FIG. 7 shows a diagrammatic representation of an insert in a first embodiment.
Figure 8:
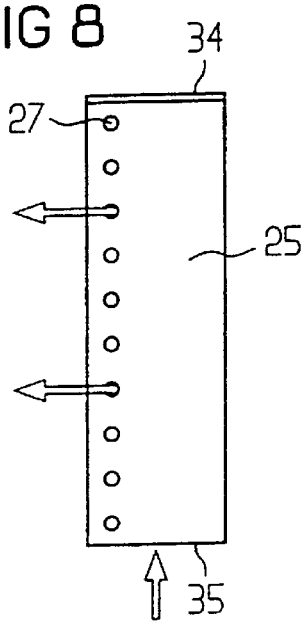
FIG. 8 shows a view similar to FIG. 7 in a second embodiment.

FIGS. 7 and 8 show two embodiments of the insert 25. In the embodiment of FIG. 7, the cooling fluid is supplied from both ends 34, 35 of the insert and emerges through the openings 27. Such an insert 25 can, for example, be used in the first blading row.

As an alternative, an insert 25, which is closed at the end 34, can—as shown in FIG. 8—be provided. The cooling fluid is then only supplied via the end 35. This insert 25 is used in the further blading rows, in which only one end of the guide vane 13 or of the rotor blade 14 can have cooling fluid admitted to it via the casing 11 or the rotor 12. Because of the horizontal ribs 24 provided according to an embodiment of the invention, there is a directed flow of the cooling fluid along the outer walls 19, 20. The cooling effect is therefore substantially improved. At the same time, simple manufacture is possible because it is possible to dispense with blades/vanes with hollow walls.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine blade/vane, comprising:

at least one channel, bounded by walls, at least one wall including a plurality of horizontal ribs and outlet openings;

an insert, provided with openings through which a cooling fluid can flow, being inserted into at least one channel, wherein the horizontal ribs are located between the insert and the walls, wherein the cooling fluid can emerge through the openings from the insert into a chamber through which the cooling fluid can flow, the chamber being formed from the horizontal ribs, the insert and the at least one wall, and wherein the openings of the insert are arranged at a first end of the chamber and cooling fluid outlet openings in the at least one wall are arranged at a second end of the chamber; and a plurality of turbulators, provided between the horizontal ribs, to improve heat exchange between the at least one wall and the cooling fluid.

2. The blade/vane as claimed in claim 1, wherein the blade/vane is configured as at least one of a guide vane and a rotor blade of a turbomachine.

3. A turbomachine, including the blade/vane of claim 1.

4. The blade/vane as claimed in claim 1, wherein the horizontal ribs are arranged substantially at right angles to a longitudinal center line of the blade/vane.

5. The blade/vane as claimed in claim 4, wherein the insert is closed at one end.

6. The blade/vane as claimed in claim 4, wherein the turbulators are used to reinforce the at least one wall and merge into one another and into the horizontal ribs.

7. The blade/vane as claimed in claim 4, wherein the blade/vane is configured as at least one of a guide vane and a rotor blade of a turbomachine.

8. The blade/vane as claimed in one of claim 1, wherein the insert is closed at one end.

9. The blade/vane as claimed in claim 8, wherein the turbulators are used to reinforce the at least one wall and merge into one another and into the horizontal ribs.

10. The blade/vane as claimed in claim 1, wherein the turbulators have a substantially straight configuration.

11. The blade/vane as claimed in claim 10, wherein the wall thickness of the at least one wall is reduced, at least in the region between the turbulators.

12. The blade/vane as claimed in claim 10, wherein the turbulators are arranged in such a way that, together with the horizontal ribs, they form recesses adjacent to one another in the form of polygons.

13. The blade/vane as claimed in claim 1, wherein the turbulators are used to reinforce the at least one wall and merge into one another and into the horizontal ribs.

14. The blade/vane as claimed in claim 13, wherein the blade/vane is configured as at least one of a guide vane and a rotor blade of a turbomachine.

15. The blade/vane as claimed in claim 13, wherein the turbulators have a substantially straight configuration.

16. The blade/vane as claimed in claim 15, wherein the turbulators are arranged in such a way that, together with the horizontal ribs, they form recesses adjacent to one another in the form of polygons.

17. The blade/vane as claimed in claim 13, wherein the turbulators are arranged in such a way that, together with the horizontal ribs, they form recesses adjacent to one another in the form of polygons.

18. The blade/vane as claimed in claim 17, wherein the turbulators are arranged in such a way that, together with the horizontal ribs, they form recesses adjacent to one another in the form of at least one of triangles and rhombuses.

19. The blade/vane as claimed in claim 17, wherein the wall thickness of the at least one wall is reduced, at least in the region between the turbulators.

* * * * *